US007069742B2

(12) United States Patent
Gershtein

(10) Patent No.: US 7,069,742 B2
(45) Date of Patent: Jul. 4, 2006

(54) HIGH-PRESSURE DELIVERY SYSTEM FOR ULTRA HIGH PURITY LIQUID CARBON DIOXIDE

(75) Inventor: Vladimir Yliy Gershtein, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 369 days.

(21) Appl. No.: 10/760,677

(22) Filed: Jan. 19, 2004

(65) Prior Publication Data

US 2005/0155377 A1 Jul. 21, 2005

(51) Int. Cl.
*F25J 3/00* (2006.01)

(52) U.S. Cl. ..... 62/617; 62/50.2; 62/602; 62/928

(58) Field of Classification Search ..... 62/50.2, 62/602, 617, 928
See application file for complete search history.

(56) References Cited

U.S. PATENT DOCUMENTS

| | | | |
|---|---|---|---|
| 2,551,399 | A | 5/1951 | Silverberg |
| 3,317,278 | A | 5/1967 | Ruhemann et al. |
| 5,377,705 | A | 1/1995 | Smith, Jr. et al. |
| 5,772,783 | A | 6/1998 | Stucker |
| 5,894,742 | A | 4/1999 | Friedt |
| 5,908,510 | A | 6/1999 | McCullough et al. |
| 6,023,933 | A | 2/2000 | Langan et al. |
| 6,327,872 | B1 | 12/2001 | Boyd et al. |

FOREIGN PATENT DOCUMENTS

| | | | |
|---|---|---|---|
| JP | 2002327895 | A | 11/2002 |
| WO | WO 03/033114 | A1 | 4/2003 |
| WO | WO 03/033428 | A1 | 4/2003 |

*Primary Examiner*—Cheryl Tyler
*Assistant Examiner*—B. Clayton McCraw
(74) *Attorney, Agent, or Firm*—Geoffrey L. Chase

(57) ABSTRACT

This invention relates to an improvement in a process and apparatus for delivering ultra high purity liquid carbon dioxide to a point of use at pressures above ambient without pumping. In the process a high purity carbon dioxide feed is charged to a vessel and at least partially solidified. Once filled, the slush or solid is isochorically heated, i.e., heated at constant vessel volume whereby the solid phase carbon dioxide is converted to a liquid. Liquid, then, is withdrawn from the vessel at a desired pressure at a rate at which the solid phase carbon dioxide is converted to a liquid. The improvement resides in effecting partial solidification and recycle of carbon dioxide.

9 Claims, 1 Drawing Sheet

Combined Pump Free and Recycle System

Combined Pump Free and Recycle System
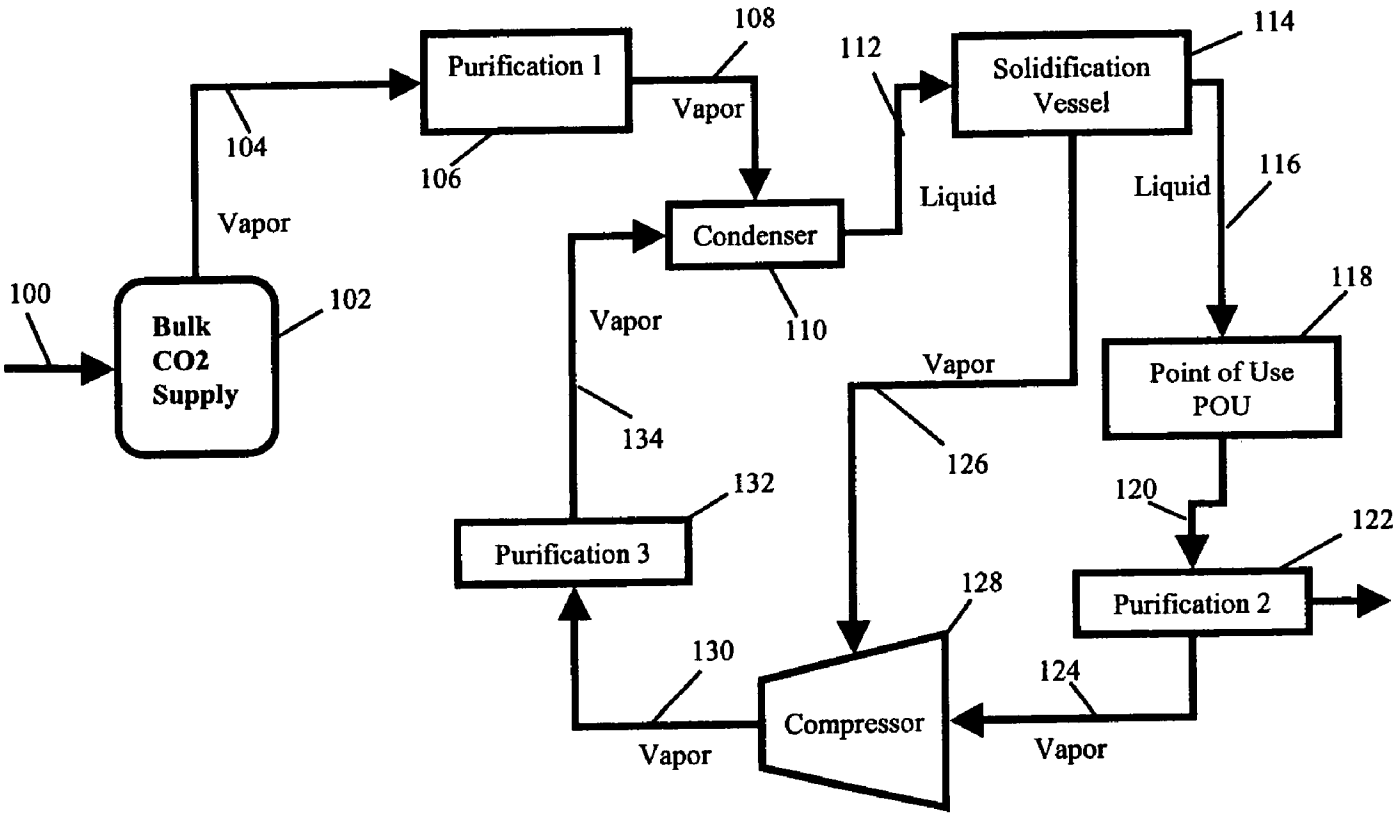

HIGH-PRESSURE DELIVERY SYSTEM FOR ULTRA HIGH PURITY LIQUID CARBON DIOXIDE

CROSS-REFERENCE TO RELATED APPLICATIONS

This application is related to U.S. Ser. No. 10/353,188 having a filing date of Jan. 28, 2003 and U.S. Ser. No. 10/753,315 having a filing date of Jan. 9, 2004, the subject matter of both companion applications incorporated by reference.

BACKGROUND OF THE INVENTION

Highly pressurized, ultra high pure liquid carbon dioxide is required for a variety of industrial processes. For example, some of the evolving applications in the electronic industry demand the use of supercritical carbon dioxide at high flow rates and high pressures. Other applications, such as photoresist removal, deposition, lithography, etc, require ultra high purity (UHP) liquid carbon dioxide delivered to a point of use (POU) in pressure range from 2,000 psig to 10,000 psig. The latter depends on many factors for example, specifics of an application, tool design, process philosophy, etc.

One of the methods for achieving high pressure carbon dioxide has been to pump liquid carbon dioxide to the desired delivery pressure. However, pumping liquid carbon dioxide to a high pressure can introduce impurities, such as particulates, hydrocarbons, halocarbons, etc., to the product stream.

In recently planned or developed onsite processes the amount of carbon dioxide delivered to the point of use is significant. In these cases the recycle of spent carbon dioxide from the point of use may improve the economics of the process.

There following patents are representative of processes for delivery of ultra high purity high pressure gases and liquids and recovery processes therefor.

U.S. Pat. No. 6,023,933 discloses a process which is capable of delivering ultra high purity (UHP) argon gas at pressures up to 67,000 psig for applications such as semiconductor manufacture. In the process a high purity gas is provided in a liquefied physical state, introduced to a vaporization vessel, and then, heated in an isochoric vaporizer sufficiently to vaporize the liquefied gas. As the liquid is vaporized in the isochoric vaporizer the pressure builds to the desired pressure, e.g., from 10,000 to 67,000 psig. When the liquid is substantially vaporized, another unit is used for vapor delivery.

U.S. Pat. No. 6,327,872 discloses a process for delivering liquid carbon dioxide to a point of use at pressures of 750 to 1020 psig. Their approach is to deliver liquid carbon dioxide to an accumulation vessel and then isochorically heat the liquid carbon dioxide contained therein and thereby elevate the pressure. If isochoric heating continues above the critical temperature of about 31° C., liquid carbon dioxide is converted into a supercritical fluid and liquid carbon dioxide can no longer be delivered to the point of use.

WO 03/033114 A1 and WO 03/033428 A1 disclose $CO_2$ onsite delivery systems for multiple applications from a first carbon dioxide purification means. The purification means includes at least one means such as catalytic oxidizer, a distillation column, a phase separator or adsorption column. Multiple effluents are generated by the differing applications which effluents comprise a carbon dioxide component and a contaminant component. At least a portion of at least one effluent stream is recycled back to a first purification means which is located between the bulk $CO_2$ storage and delivery application. The '428 disclose the use of a second carbon dioxide purification means for creating a pre-purified feed.

There is a need to create a pump free system which can deliver UHP high pressure liquid carbon dioxide at elevated pressures and achieve recovery of spent gas discharged from the point of use.

SUMMARY OF INVENTION

This invention relates to an improvement in earlier processes described in related copending applications for delivering high pressure liquid carbon dioxide to a point of use at pressures above ambient pressure, typically in excess of 2000 psig. The basic process comprises at least partially solidifying carbon dioxide in a solidification vessel, isochorically heating the solid phase carbon dioxide in said solidification vessel thereby increasing the pressure in the solidification vessel, withdrawing high pressure liquid carbon dioxide from said solidification vessel and delivering the high pressure liquid carbon dioxide to said point of use. The improvement for effecting recovery of spent carbon dioxide from said point of use and integrating recovery with the regeneration step of at least partially solidifying said carbon dioxide in said solidification vessel comprises:

optionally passing the spent carbon dioxide through an initial purification step to remove contaminating point of use impurities contained in the spent gas;

withdrawing and vaporizing liquid carbon dioxide from said solidification vessel under conditions for at least partially solidifying carbon dioxide in said solidification vessel;

combining the resulting withdrawn and expanded carbon dioxide from said solidification vessel with the resulting purified spent gas forming a combined carbon dioxide stream;

compressing the combined carbon dioxide gas stream to process pressure;

optionally passing the resulting combined, compressed gas through a purifier to remove compressor contaminates; and, introducing the purified, combined compressed gas to the process upstream of the solidification vessel.

There are significant advantages to the process and these include:

an ability to deliver liquid carbon dioxide to a point of use and integrate the solidification of liquid carbon dioxide in the solidification vessel with the recovery of spent gas from the point of use and recycle into the process;

an ability to combine a pump free, high-pressure UHP liquid $CO_2$ delivery system with a $CO_2$ recycle system in order to eliminate duplicate and expensive compressors, and purification systems;

an ability to avoid the use of pumps or compressors directly upstream of the point of use and yet be able to deliver purified liquid carbon dioxide stream to a point of use at virtually any operating pressure; and, an ability to integrate the conversion of liquid carbon dioxide to solid carbon dioxide with the recovery of spent carbon dioxide from the point of use;

DESCRIPTION OF THE DRAWING

The FIGURE is a flow diagram of a combined pump free and recycle system for the delivery of high-pressure UHP liquid $CO_2$ to a point of use (POU) in combination with a $CO_2$ recycle and regeneration system.

DETAILED DESCRIPTION OF THE INVENTION

To facilitate an understanding of the basic process, reference is made to the drawing.

The FIGURE describes an onsite system for the pump free delivery of ultra high purity liquid carbon dioxide to a point of use and the recovery of the spent carbon dioxide.

In the general process, a stream of liquid carbon dioxide at initial process pressure and temperature parameters, for example, a liquid carbon dioxide process pressure of 300 psig and temperature of −5° F. is delivered via line 100 to bulk $CO_2$ supply tank 102. Carbon dioxide then is removed from bulk $CO_2$ supply tank 102 through line 104 and charged to purification system 106 to remove contaminants normally present in bulk $CO_2$ deliveries. (Semiconductor processes, for example, require higher purities than afforded in industrial grade bulk delivery $CO_2$.) Purification of the feed may require different methods, e.g., filtration, distillation, adsorption and the like to achieve the desired carbon dioxide purity required in the application.

Following purification, the ultra high purity carbon dioxide is withdrawn from purification system 106 via line 108 and sent to condenser 110 at process pressure. Vapor is converted to liquid form, and liquid is withdrawn via line 112 where it is charged to solidification vessel 114. Optionally, it is possible to bypass condenser 110 and deliver vapor from the purification system 106 directly to solidification vessel 114. However, it is preferred to introduce liquid carbon dioxide as opposed to carbon dioxide vapor to solidification vessel 114.

In solidification vessel 114, at least a portion of the liquid carbon dioxide is solidified and the vessel continued to be filled until there is a substantial amount of solid carbon dioxide therein. As solid carbon dioxide is formed, additional liquid carbon dioxide from condenser 110 is added to solidification vessel 114 until it is substantially, or preferably completely, filled with solid carbon dioxide or preferably with a solid-liquid mixture of carbon dioxide, i.e., slush. Since the density of the solid carbon dioxide is approximately 1.5 times greater than that of carbon dioxide in the liquid state, as substantial amount of carbon dioxide is available for delivery at high pressure. To aid the solidification process chillers, e.g., heat exchangers, typically internal to solidification vessel 114 may be employed.

To effect conversion of solid phase carbon dioxide to liquid and effect pressurization thereof within solidification vessel 114, solidification vessel 114 is separated from the upstream system, e.g., condenser 110 by closing appropriate valves (not shown). Heat is added by heaters (not shown) and conversion of solid carbon dioxide to a liquid is effected. Isochoric heating, i.e., heating of carbon dioxide while maintaining a constant volume inside solidification vessel 114 provides the mechanism to increase the pressure of the thus formed liquid carbon dioxide to any pressure desired in the process. The liquid carbon dioxide is preferably delivered from solidification vessel 114 at a pressure within a range of 300 to 10,000 psig, and at a delivery temperature, for example, of room temperature, e.g., 77° F. but below the critical temperature. And, such pressure can be achieved without effecting a significant change in the average slush temperature or internal temperature of carbon dioxide within solidification vessel 114. It is also possible to operate over a narrow temperature range and the ability to operate over a narrow temperature range allows for efficient use of energy within solidification vessel 114.

Liquid carbon dioxide is withdrawn from solidification vessel 114 via line 116 and delivered to the point of use designated 118. Liquid carbon dioxide product is withdrawn and removed from solidification vessel 114 at a rate which is generally equal to the melting rate of the solid carbon dioxide contained therein. In this way, then, the removal of liquid carbon dioxide from solidification vessel 114 will be immediately replaced with liquid carbon dioxide formed on conversion of the solid carbon dioxide to liquid carbon dioxide. By effecting withdrawal of liquid carbon dioxide at a rate substantially equal to the rate of formation of liquid carbon dioxide, the pressure inside solidification vessel 114 can be maintained at the desired level. Withdrawal of liquid carbon dioxide from the solidification vessel 114 is terminated when the solid phase carbon dioxide is substantially or completely converted to liquid. The delivery of the remaining liquid $CO_2$ inside solidification vessel 114 to the point of use 118 at the desired pressure is no longer possible. Regeneration is required.

If the end users desire to employ supercritical carbon dioxide in their point of use application, the liquid carbon dioxide delivered from the solidification vessel 114 can be heated sufficiently at the site to form said supercritical carbon dioxide and the resulting supercritical carbon dioxide employed. In many cases, supercritical carbon dioxide is an alternative to liquid carbon dioxide in that it has similar properties to the liquid form.

At this point, the pump free process cycle starts from the beginning. This means that the liquid carbon dioxide now remaining in solidification vessel 114 must be reduced in temperature, the contents at least partially solidified and additional $CO_2$ makeup provided. Otherwise removal of liquid from solidification vessel 114, absent conversion of solid $CO_2$ to liquid $CO_2$, will result in an immediate and substantial reduction in liquid delivery pressure. To provide for continuous liquid carbon dioxide flow to a point of use, multiple units are employed such that as the solid carbon dioxide phase is exhausted in one solidification vessel, appropriate valves are opened and closed and identical pump free units placed on stream.

The improvement associated with this invention lies in the recovery of spent carbon dioxide gas from point of use 118 and its integration with the carbon dioxide solidification process in solidification vessel 114. Spent carbon dioxide gas is removed from point of use 118 via line 120 and charged to purification unit 122. The purification process employed is one that allows for the removal of the contaminating impurities imparted to the carbon dioxide at the point of use. Depending upon the type of impurities now present in the spent carbon dioxide gas in line 120, impurity removal may be as simple as effecting condensation and separation of the liquid from the impurities now in the vapor phase or it may require more rigorous procedures, e.g., filtration, distillation, adsorption and the like. Purification methods to achieve the desired purity are within the province of the process operators.

A considerable amount of $CO_2$ exits the purification unit 122 as a vapor stream and the pressure of the vapor stream in line 124 is lower then that of the upward streams, e.g., condenser 110. Therefore, the spent carbon dioxide, now purified, must be compressed in order to recover and return the carbon dioxide back into the process.

In an effort to minimize capital requirements associated with high cost refrigeration, integration of the recovery process with the carbon dioxide solidification step is a preferred option. In this step, vapor formed at the high process delivery pressure in solidification vessel 114 is withdrawn via line 126 and isenthalpically or isentropically expanded to a pressure equal to or slightly below, e.g., 5 to 10 psia, the triple point pressure of carbon dioxide, i.e., 75 psia thereby lowering the temperature in solidification vessel 114. Alternatively, expansion can be continued to a pressure slightly above atmospheric but that is not energy efficient as will be explained. With isenthalpic or isentropic expansion there is a corresponding reduction in temperature and partial solidification of the liquid carbon dioxide contents in solidification vessel 114 is effected. Isenthalpic expansion is preferred from a cost standpoint as isenthalpic expansion in contrast to work or isentropic expansion does not introduce additional impurities into the gas stream. Additional liquid is introduced into solidification vessel 114 and expansion continued until a desired level of solid carbon dioxide is achieved. Using the technique of isenthalpic or isentropic expansion allows one to eliminate or minimize the size of chillers and associated refrigeration equipment in solidification vessel 114 and thereby reduce capital costs.

To recycle the purified spent gas now in line 124 and expanded vapor from solidification vessel 114 now in line 126, a compressor 128, is used to compress the vapors in line 124 and 126 to plant process pressure. In the process shown in the drawing, compressor 128 is a two stage compressor. Carbon dioxide vapor in line 124, which is typically above atmospheric to prevent air leakage into the point of use 118, is expanded to the pressure of expanded carbon dioxide vapor in line 126. The two gas streams now at similar pressures are combined and introduced to the second stage of compressor 128 and compression of the combined stream to process pressure is effected. Had the vapor in line 126 been expanded to the pressure of the spent gas in line 124 both streams would have to be compressed to the process pressure. That option of expanding and then recompressing carbon dioxide obtained from line 126 is not energy efficient.

Subsequent to compression in compressor 128, additional purification, as a preferred option, is carried out to remove impurities which may have been introduced by compressor 128. In effecting purification, compressed vapor is removed from compressor 128 via line 130 and possible impurities, e.g., hydrocarbons oils are removed in purification unit 132.

As can be readily observed the purification units 106, 122 and 132 often employ different mechanisms for effecting purification of the respective feed streams thereto because of the wide differences in the impurities contained in the respective streams. Thus, three purification systems are shown in the drawing and are preferred from an operational standpoint. However, it is possible to reduce the number of purifiers and move purification to different places in the process. For example, purification of the spent carbon dioxide from the point of use may be transferred to a point subsequent to compression and the combined streams processed or the combined, compressed carbon dioxide streams transferred to the initial purification unit where impurities from the bulk supply are removed. However, purification after compression at these points would require differing purification systems sufficient to treat the larger volume of gas and differing purification procedures. For example, purification of the recycle gases in the bulk supply unit purifier 106 is not preferred because of the increased volume of gases to be treated and because impurities in the bulk supply had already been removed from expanded vapor obtained from solidification vessel 114. Likewise, there is no benefit in contaminating the vapor from solidification vessel with the impurities in the spent carbon dioxide from the point of use. From an operational point of view, it is simpler to purify each stream as shown, but where and how purification of the streams is conducted is within the province of the operator.

After purification in purification chamber 132, the vapor is removed via line 134 and returned to the process upstream of the solidification vessel 114. As shown in the drawings, the vapor is returned to condenser 110 where it is condensed. Optionally, the purified stream could be returned to bulk $CO_2$ supply tank 102 but this would increase the load on purification unit 106. Such return is not necessary since the purity of carbon dioxide in vapor in line 134 is free of contaminants present in the bulk $CO_2$ supply feed.

The invention claimed is:

1. In a process for delivering high pressure liquid carbon dioxide to a point of use at elevated pressure which comprises introducing carbon dioxide to a solidification vessel at process pressure and temperature, at least partially solidifying carbon dioxide in a solidification vessel, isochorically heating the solid phase carbon dioxide in said solidification vessel thereby increasing the pressure in the solidification vessel, withdrawing high pressure liquid carbon dioxide from said solidification vessel and delivering the high pressure liquid carbon dioxide to said point of use, the improvement for effecting recovery of spent carbon dioxide from said point of use and integrating recovery with the regeneration step of at least partially solidifying said carbon dioxide in said solidification vessel which comprises:

withdrawing and vaporizing liquid carbon dioxide from said solidification vessel under conditions for at least partially solidifying carbon dioxide in said solidification vessel;

combining the resulting withdrawn and expanded carbon dioxide from said solidification vessel with the spent gas from said point of use forming a combined carbon dioxide stream;

compressing the combined carbon dioxide gas stream to process pressure;

removing impurities contained in the spent carbon dioxide; and, introducing the resulting compressed gas to the process upstream of the solidification vessel.

2. The process of claim 1 wherein the feed stream is liquid carbon dioxide and it is delivered to said solidification vessel for conversion to solid phase carbon dioxide.

3. The process of claim 2 wherein the elevated pressure is within a range from 300 to 10,000 psig.

4. The process of claim 3 wherein the carbon dioxide in the solidification vessel is converted to a slush comprised of solid and liquid carbon dioxide.

5. The process of claim 1 wherein the spent carbon dioxide from said point of use is purified in a purification step to remove impurities contained in the spent carbon dioxide prior to compressing.

6. The process of claim 5 wherein the compressed gas from said compressing step is sent to a purifier to remove possible compressor contaminants introduced to said compressed gas.

7. The process of claim 5 wherein the withdrawing and vaporizing of carbon dioxide for partially solidifying carbon dioxide is effected by isenthalpic expansion.

8. The process of claim 7 wherein isenthalpic expansion is effected to a pressure equal to or slightly below the critical pressure of carbon dioxide.

9. The process of claim 8 wherein a two stage compressor is employed and spent carbon dioxide from the point of use is compressed in the initial stage of said compressor, combined with the isenthalpically expanded carbon dioxide from said solidification vessel and compressed to process pressure.

* * * * *